US005856269A

United States Patent [19]

Hayashi et al.

[11] Patent Number: 5,856,269

[45] Date of Patent: Jan. 5, 1999

[54] THERMAL TRANSFER MEDIUM

[75] Inventors: Masafumi Hayashi; Koichi Nakamura; Fumihiko Mizukami, all of Tokyo, Japan

[73] Assignee: Dai Nippon Printing Co., Ltd., Japan

[21] Appl. No.: 728,330

[22] Filed: Oct. 10, 1996

Related U.S. Application Data

[60] Continuation of Ser. No. 328,284, Oct. 5, 1994, abandoned, which is a division of Ser. No. 133,255, Oct. 8, 1993, abandoned.

[30] Foreign Application Priority Data

| | | | |
|---|---|---|---|
| Oct. 13, 1992 | [JP] | Japan | 4-300532 |
| Apr. 13, 1993 | [JP] | Japan | 5-109927 |
| Apr. 23, 1993 | [JP] | Japan | 5-120923 |
| May 25, 1993 | [JP] | Japan | 5-145540 |

[51] Int. Cl.[6] ..... B41M 5/26; B41M 5/38

[52] U.S. Cl. ..... 503/227; 503/206; 428/194; 428/323; 428/327

[58] Field of Search ..... 428/195, 204, 428/484, 488.4, 323, 327, 194; 503/206, 227

[56] References Cited

U.S. PATENT DOCUMENTS

| | | | |
|---|---|---|---|
| 4,880,686 | 11/1989 | Yaegashi et al. | 428/212 |
| 5,264,279 | 11/1993 | Imamura et al. | 428/488.4 |
| 5,270,073 | 12/1993 | Koshizuka et al. | 427/146 |

*Primary Examiner*—Pamela R. Schwartz
*Attorney, Agent, or Firm*—Parkhurst & Wendel, L.L.P.

[57] ABSTRACT

When a thermal transfer film and a material, on which an image is to be transferred, are spottedly adhered to each other with adhesive particles, the adhesive strength can be successfully regulated as desired and it becomes possible to provide a thermal transfer medium having an excellent storage stability. The present invention relates to a thermal transfer medium comprising: a thermal transfer film having a substrate film and a hot-melt ink layer provided on the substrate film; and an image receiving sheet adhered in a peelable manner to the thermal transfer film on the side of the hot-melt ink layer through a temporary adhesive layer, the temporary adhesive layer including adhesive particles and a binder, the thermal transfer film on the side of the hot-melt ink layer and the image receiving sheet being spottedly adhered to each other. Also disclosed is a thermal transfer medium including: a thermal transfer film having a substrate film and a hot-melt ink layer provided on the substrate film; and an image receiving sheet adhered in a peelable manner to the thermal transfer film on the side of the hot-melt ink layer, the hot-melt ink layer containing adhesive particles, the thermal transfer film on the side of the hot-melt ink layer and the image receiving sheet being spottedly adhered to each other. Also disclosed is a thermal transfer medium including: a thermal transfer film having a substrate film and a hot-melt ink layer provided on the substrate film; and an image receiving sheet adhered in a peelable manner to the thermal transfer film on the side of the hot-melt ink layer, the hot-melt ink layer containing a thermoplastic elastomer having a rubber elasticity.

3 Claims, 1 Drawing Sheet

THERMAL TRANSFER MEDIUM

This is a Continuation of application Ser. No. 08/328,284 filed Oct. 5, 1994, now abandoned, which in turn is a divisional of application Ser. No. 08/133,255, filed Oct. 8 1993, now abandoned.

BACKGROUND OF THE INVENTION

The present invention relates to a thermal transfer sheet, and more particularly to an integral thermal transfer medium comprising a thermal transfer film having a hot-melt ink layer (an ink-providing material) and an image receiving sheet (a material on which the ink layer is to be transferred to form an image) temporarily bonded to the thermal transfer film.

A thermal transfer film (an ink film) comprising a substrate film and a hot-melt ink layer provided on one surface of the substrate film has hitherto been used as a thermal transfer recording medium for thermal printers, facsimile machines, etc. Printing on paper using the thermal transfer film is effected by a method which comprises feeding a thermal transfer film from a roll on which the thermal transfer film has been wound, separately feeding an image receiving sheet in a continuous or sheet form, putting both materials on top of the other on a platen, and applying heat in this state with a thermal head from the back surface of the substrate film to form a desired image.

These thermal transfer media, however, cannot be applied to, for example, a facsimile printer using the conventional thermosensitive coloring paper because the conventional facsimile printer effects printing by taking advantage of thermal coloring of recording paper per se and is not provided with a mechanism for separately carrying a thermal transfer film (an ink film) and an image receiving sheet.

In order to solve the above-described problem, a method has been devised wherein the thermal transfer film is temporarily adhered in advance to the image receiving sheet and the laminate is rolled and applied to the facsimile printer.

This co-rolled thermal transfer medium comprising a thermal transfer film and an image receiving sheet in an integral form has an adhesive layer that serves to adhere the thermal transfer film to the image receiving sheet and enables the thermal transfer film and the image receiving sheet to be peeled from each other after the completion of the thermal transfer. Since a material having a low softening point, such as a sticking agent, is mainly used in the conventional ink, the initial adhered state changes due to the occurrence of unfavorable phenomena, such as creeping, softening and melting with time or during storage at a high temperature. Such changes cause problems of an abnormal transfer of the hot-melt ink layer to the image receiving sheet when the transfer film is peeled from the image receiving sheet. Further, in the conventional co-rolled thermal transfer medium, since the thermal transfer film and the image receiving sheet are adhered to each other in a face-to-face manner, when use is made of a material having a high adhesive force, such as an adhesive resin, the above-described problem becomes more significant and problems particularly associated with the storage and peeling occur.

SUMMARY OF THE INVENTION

Accordingly, an object of the present invention is to provide a co-rolled (integral) thermal transfer medium that can easily regulate the strength of temporary adhesion between the thermal transfer film and the image receiving sheet depending upon applications and maintain the quality for a long period of time.

The above-described object can be attained by the following present invention.

According to the first aspect of the present invention, there is provided a thermal transfer medium comprising: a thermal transfer film comprising a substrate film and a hot-melt ink layer provided on said substrate film; and an image receiving sheet adhered in a peelable manner to said thermal transfer film on the side of said hot-melt ink layer through a temporary adhesive layer, said temporary adhesive layer comprising adhesive particles and a binder, said thermal transfer film on the side of said hot-melt ink layer and said image receiving sheet being spottedly adhered to each other.

The use of adhesive particles for temporarily adhering the thermal transfer film and the image receiving sheet to each other enables the thermal transfer film to be spottedly adhered to the image receiving sheet, so that not only the adhesive strength can be successfully regulated as desired but also it becomes possible to provide a thermal transfer medium having an excellent storage stability.

According to the second aspect of the present invention, there is provided a thermal transfer medium comprising: a thermal transfer film comprising a substrate film and a hot-melt ink layer provided on said substrate film; and an image receiving sheet adhered in a peelable manner to said thermal transfer film on the side of said hot-melt ink layer, said hot-melt ink layer containing adhesive particles, said thermal transfer film on the side of said hot-melt ink layer and said image receiving sheet being spottedly adhered to each other.

The addition of adhesive particles to the hot-melt ink layer enables the hot-melt ink layer, as such, to have a temporary adhesive property and, therefore, can eliminate the need of separately providing a temporary adhesive layer, which contributes to an improvement in the printing sensitivity and, at the same time, can advantageously simplify the production process. Further, since the thermal transfer film and the image receiving sheet can be spottedly adhered to each other, the adhesive strength can be successfully regulated as desired and, further, the particle shape of the adhesive particles remains unchanged during storage, so that the spottedly adhered state can be maintained during storage, which contributes to an improvement in the storage stability.

According to the third aspect of the present invention, there is provided a thermal transfer medium comprising: a thermal transfer film comprising a substrate film and a hot-melt ink layer provided on said substrate film; and an image receiving sheet adhered in a peelable manner to said thermal transfer film on the side of said hot-melt ink layer, said hot-melt ink layer containing a thermoplastic elastomer having a rubber elasticity.

The addition of the thermoplastic elastomer having a rubber elasticity to the hot-melt ink layer enables the hot-melt ink layer, as such, to have a temporary adhesive property and can enhance the cohesive force of the hot-melt ink layer. Therefore, it is possible to prevent the occurrence of printing failure such as reverse transfer and tailing. Further, the additional provision of an adhesive layer on the ink layer can provide a thermal transfer medium less susceptible to wrinkling.

BEST MODE FOR CARRYING OUT THE INVENTION

The present invention will now be described in more detail with reference to the following embodiments.

Figure 1:
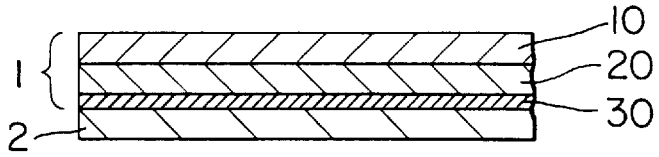
FIGS. 1 to 6 are cross-sectional views of embodiments of the thermal transfer medium according to the present invention.
Figure 2:
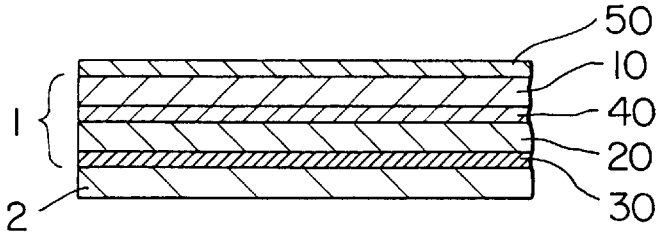

Preferred embodiments of the thermal transfer medium according to the first aspect of the present invention are shown in FIGS. 1 and 2.

As shown in FIG. 1, the thermal transfer medium of the present invention is a co-rolled thermal transfer medium comprising a thermal transfer film 1 and an image receiving sheet 2 adhered to the thermal transfer film in a peelable manner. The thermal transfer film 1 comprises a film 10, an ink layer 20 provided on the film 1, said ink layer comprising a pigment and a binder, and, provided between the ink layer 20 and the image receiving sheet 2, a temporary adhesive layer 30 comprising adhesive particles and a binder and capable of holding the thermal transfer film and the image receiving sheet in a spottedly adhered state. The embodiment shown in FIG. 2 is an application example of the thermal transfer medium of the present invention. In this embodiment, a peeling layer and/or a matte layer 40 are formed between the substrate film 10 and the ink layer 20. A slip layer 50 may be provided on the back surface of the substrate film 10.

Any substrate film used in the conventional thermal transfer medium, as such, may be used as the substrate film in the thermal transfer medium of the present invention. Further, use may be made of other substrate films, and the substrate film is not particularly limited.

Specific preferred examples of the substrate film include plastics, such as polyesters, polypropylene, cellophane, polycarbonate, cellulose acetate, polyethylene, polyvinyl chloride, polystyrene, nylon, polyimides, polyvinylidene chloride, polyvinyl alcohol, fluororesins, chlorinated rubber and ionomers, paper, such as capacitor paper and paraffin paper, and nonwoven fabrics. Further, it is also possible to use a laminate comprising any combination of the above-described substrate films.

Although the thickness of the substrate film may be varied so as to have proper strength and heat conductivity according to the material, it is generally in the range of from about 2 to 25 $\mu$m.

A slip layer may be provided on the back surface of the substrate film for the purpose of preventing the sticking of the substrate film on the thermal head and, at the same time, improving the slip property. The material constituting such a slip layer is composed mainly of a heat-resistant resin and a substance capable of serving as a heat release agent or a lubricant. In this case, a synthetic resin having a glass transition temperature of 60° C. or above or a resin produced by adding a compound having two or more amino groups or a diisocyanate or triisocyanate to a thermoplastic resin having a —OH or —COOH group and subjecting the mixture to crosslinking for curing is suitable as the heat-resistant resin. Examples of the heat release agent and lubricant include waxes and amides, esters and salts of higher fatty acids, which develop the releasing and lubricating capability upon being melted by heating, and fluororesins and inorganic powders, which can exhibit the effect in a solid state.

The hot-melt ink layer provided on the substrate film comprises a pigment and a binder and optionally various additives. In black monocolor printing, it is a matter of course that the pigment is preferably carbon black. In multicolor printing, use may be made of chromatic color pigments such as cyan, magenta and yellow. In general, the amount of use of these pigments is preferably such that these pigments occupy about 5 to 70% by weight of the ink layer.

The binder comprises wax as the main component or a mixture of wax with a drying oil, a resin, a mineral oil, cellulose and a derivative of rubber and the like.

Representative examples of the wax include microcrystalline wax, carnauba wax and paraffin wax. Further examples of the wax usable in the binder include various waxes, such as Fischer-Tropsch wax, various types of polyethylene, Japan wax, beeswax, spermaceti, insect wax, wool wax, shellac wax, candelilla wax, petrolatum, polyester wax, partially modified wax, fatty acid esters and fatty acid amides. Further, the binder may contain at least one thermoplastic resin such ethylene/vinyl acetate copolymer.

The hot-melt ink layer can be formed on the substrate film by a hot-melt coating method which comprises heat-melting the binder composed mainly of wax together with other necessary components and coating the melt on the substrate film and other general method which comprises melt-kneading the binder composed mainly of wax together with other necessary components to provide a melt and applying the melt on the substrate film by hot lacquer coating. Further, it is also possible to use a method wherein an emulsion ink comprising a mixture of an emulsion prepared by emulsifying or dispersing a binder composed mainly of wax in an aqueous medium optionally containing an alcohol or the like with an aqueous dispersion of a pigment and a thermoplastic elastomer is coated and dried. The thickness of the ink layer thus formed is preferably in the range of from about 1 to 20 $\mu$m.

In the formation of the hot-melt ink layer, it is possible to form a matte layer having a thickness of about 0.1 to 20 $\mu$m on the surface of the substrate film to impart feeling of matte to the print. Such a matte layer can be formed by coating a coating solution containing a suitable binder, carbon black and organic or inorganic particles on the surface of the substrate film. In this case, polyester resin, polyvinyl butyral resin, polyacetal resin, cellulosic resin, acrylic resin and polyurethane resin may be used as the binder. The carbon black may be conductive carbon used in the art for the purpose of preventing the electrification of conductive plastics and ordinary plastics. The carbon black is particularly preferably a porous conductive carbon, for example, having a DBP absorption of 400 ml/100 g or more, preferably 450 to 600 ml/100 g, and specific examples of such porous conductive carbon include those commercially available as Ketjen Black EC600JD and the like. The porous conductive carbon black of this type can impart a high antistatic property through the use thereof in a small amount. In the present invention, although the conductive carbon black is used in an amount of 60% by weight or less based on the weight of the matte layer, when the conductive carbon black is porous, a good effect can be attained in a lower content. Besides the above-described carbon black, particles of inorganic materials, such as silica, alumina, clay and calcium carbonate, and plastic pigments, such as acrylic resin particles and benzoguanamine resin particles, may be properly used as the matting agent particles.

The matting agent may be used in an amount of 30% by weight or less, preferably 5 to 25% by weight, still preferably 10 to 20% by weight, based on the weight of the matte layer.

The conductive matte layer may be formed by dissolving or dispersing the above-described materials in a suitable solvent, such as acetone, methyl ethyl ketone, toluene or xylene, and, if necessary, adding a crosslinking agent, such as a polyisocyanate, to the solution or dispersion to prepare a coating solution, coating the coating solution by conventional coating means, such as a gravure coater, a roller coater or a wire bar, and drying the coating.

The matte layer for antistatic purposes preferably has a surface electric resistance of $1\times10^9\Omega$ or less under an environment of a temperature of 25° C. and a humidity of 50%. When the surface electric resistance value is in the above-described range, sticking by static electricity can be prevented in the peeling of the thermal transfer film after printing. Further, it is possible to eliminate the problem of electrification in the laminating step wherein the thermal transfer film and the image receiving sheet are put on top of the other.

Further, in the present invention, a peeling layer comprising wax may be previously formed on the surface of the substrate film or the surface of the matte layer so that, after the completion of the transfer, the peeling layer can serve as the surface protective layer for a transferred image. The peeling layer may be formed by hot-melt coating, hot lacquer coating or emulsion coating. The thickness of the peeling layer is generally in the range of from about 0.1 to 5 $\mu$m.

The image receiving sheet may be any sheet or film used as an image receiving sheet in the conventional thermal transfer medium, on which the ink layer is transferred to form an image, such as conventional wood free paper, plain paper, coat paper, synthetic paper and plastic films. Although these image receiving sheets may be in a sheet form of A-size, B-size, etc., they are preferably in the form of a continuous sheet having a proper width.

In the thermal transfer medium of the present invention, a temporary adhesive layer comprising adhesive particles and a binder is formed on the hot-melt ink layer for the purpose of spottedly adhering the thermal transfer film to the image receiving sheet.

In the present invention, particles of thermoplastic resins having a minimum film formation temperature of 50° to 150° C. are used as the adhesive particles, and examples thereof include particles of EVA, ionomers, polyethylene wax, polyolefin and other thermoplastic resins having a diameter of 1 to 100 $\mu$m, preferably 2 to 20 $\mu$m. The use of resins having a particle diameter larger than the thickness of the temporary adhesive layer enables the transfer film to be surely adhered to the image receiving sheet in a spot manner. Further, when the minimum film formation temperature of the adhesive particles is 50° C. or above, since the particle shape of the adhesive particles remains unchanged during storage even in an environment of 50° C., the storage stability can be improved. If the adhesive particles have a minimum film formation temperature below 50° C., the particle shape cannot be maintained when the temporary adhesive layer is coated and dried at a temperature of 50° C. or above, so that the thermal transfer film and the image receiving sheet are adhered to each other in a face-to-face manner but not in a spot manner, which lowers the printing sensitivity in the thermal transfer stage. On the other hand, if the adhesive particles have a minimum film formation temperature above 150° C., the ink transferability is significantly inhibited.

In the present invention, the density of spot adhesion (number of adhesive spots per $mm^2$) between the thermal transfer film and the image receiving sheet is preferably in the range of from 10 to 100,000 spots/$mm^2$. When the density of spot adhesion is less than 10 spots/$mm^2$, the adhesive strength is unsatisfactory. On the other hand, when it exceeds 100,000 spots/$mm^2$, the adhesive strength becomes so high that the ink layer is unfavorably plundered by the sheet on which the ink layer is to be transferred to form ink spots on the image receiving sheet, that is, smudging occurs.

Further, in the present invention, in order to hold the adhesive particles to form the temporary adhesive layer, it is preferred that the temporary adhesive layer contain as a binder at least one member selected from wax and a resin having a Tg value of 50° to 150° C. but not contain a resin having a Tg value below 50° C. Still preferably, use may be made of a wax emulsion or a solvent dispersion of polyester, acrylic, paraffin wax, carnauba wax, polyethylene wax or the like.

The use of a thermoplastic resin having a Tg value below 50° C. increases the tendency for blocking or other problem to occur during storage, while the use of a thermoplastic resin having a Tg value above 150° C. gives rise to a possibility that the thermal transfer of an ink layer is inhibited.

The adhesive particles are contained in an amount of 5 to 100 parts by weight based on 100 parts by weight of the binder, and the content of the adhesive particles may be selected by taking the surface profile of the image receiving sheet into consideration.

When the content of the adhesive particles is less than 5 parts by weight, the adhesive property is poor, while when it exceeds 100 parts by weight, the film forming property is unfavorably poor.

The combined use of 10 parts by weight of wax and 1 to 100 parts by weight of polyester as the binder contributes to an improvement in the printing of an image on the image receiving sheet and, at the same time, improve the adhesion to the ink layer to prevent the occurrence of smudge of the image receiving sheet.

The temporary adhesive layer preferably has an adhesive strength (g) under shear in the range of from 300 to 2,000 g as measured using a cut sample having a size of 25 mm in width×55 mm in length at a rate of pulling of 1,800 mm/min with a surface abrasion tester (HEIDON-14 manufactured by Shinto Kagaku K.K.). When the adhesive strength is less than the above-described range, since the adhesion between the thermal transfer film and the image receiving sheet is excessively low, the thermal transfer film and the image receiving sheet are likely to peel from each other and the thermal transfer medium is likely to wrinkle. On the other hand, when the adhesive strength exceeds the above-described range, although the adhesion between the thermal transfer film and the image receiving sheet is satisfactory, the ink layer is likely to be transferred to the image receiving sheet also in the non-printing portion, so that the image receiving sheet gives rise to smudge.

The temporary adhesive layer is formed by coating a solution comprising adhesive particles and a binder by gravure coating, reverse coating or the like to provide a layer having a thickness of 0.05 to 10 $\mu$m.

With respect to the adhering between the thermal transfer film and the image receiving sheet, the image receiving sheet is continuously adhered to the thermal transfer film by taking advantage of the adhesive property imparted to the temporary adhesive layer of the thermal transfer film, and the laminate is rolled. The laminate may be rolled with the image receiving sheet being outward or the thermal transfer film being outward. Further, the laminate may be cut into sheets.

Figure 3:
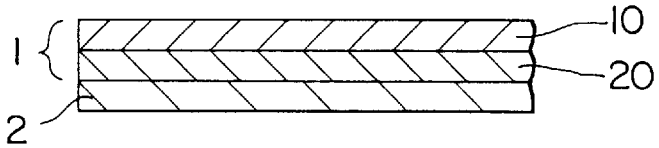

The thermal transfer medium according to the second aspect of the present invention will now be described with reference to the following preferred embodiments. As shown in FIG. 3, the thermal transfer medium according to the second aspect of the present invention comprises a thermal transfer film 1 and an image receiving sheet 2 adhered to the thermal transfer film in a peelable manner. The thermal transfer film 1 comprises a film 10 and, provided thereon, an ink layer 20 containing a pigment, a binder and adhesive particles.

The substrate film used in the thermal transfer medium according to the second aspect of the present invention is the same as that described above in connection with the thermal transfer medium according to the first aspect of the present invention.

In order to prevent the sticking of the substrate film on the thermal head and, at the same time, to improve the slip property, it is also possible to provide the same slip layer as that described above on the back surface of the substrate film. The hot-melt ink layer provided on the substrate film comprises a pigment, a binder and adhesive particles and optionally various additives. In black monocolor printing, it is a matter of course that the pigment is preferably carbon black. In multicolor printing, use may be made of chromatic color pigments such as cyan, magenta and yellow. In general, the amount of use of these pigments is preferably such that these pigments occupy about 5 to 70% by weight of the ink layer.

The binder comprises wax as the main component or a mixture of wax with a drying oil, a resin, a mineral oil, cellulose and a derivative of rubber and the like.

Representative examples of the wax include microcrystalline wax, carnauba wax and paraffin wax. Further examples of the wax usable in the binder include various waxes, such as Fischer-Tropsch wax, various types of polyethylene, Japan wax, beeswax, spermaceti, insect wax, wool wax, shellac wax, candelilla wax, petrolatum, polyester wax, partially modified wax, fatty acid esters and fatty acid amides. Further, the binder may contain at least one thermoplastic resins such ethylene/vinyl acetate copolymer.

The present invention is characterized in that the above-described ink layer further comprises adhesive particles.

In the present invention, particles of thermoplastic resins having a minimum film formation temperature of 50° to 150° C. are used as the adhesive particles, and examples thereof include particles of EVA, ionomers, polyethylene wax, polyolefin and other thermoplastic resins. If the adhesive particles have a minimum film formation temperature below 50° C., the particle shape of the adhesive particles cannot be maintained when the ink layer is formed, so that there occur problems including the effect of spot adhering cannot be attained. On the other hand, if the adhesive particles have a minimum film formation temperature above 150° C., there occur problems such as a significant inhibition of the transfer of the ink layer. The adhesive particles have a diameter in the range of from 0.1 to 100 $\mu$m. When they have a diameter of less than 0.1 $\mu$m, it is difficult to spottedly adhere the thermal transfer film to the image receiving sheet. On the other hand, when the particle diameter exceeds 100 $\mu$m, the printing sensitivity is lowered. However, the protrusion of the particles from the surface of the ink layer, which enables the transfer film to be spottedly adhered to the image receiving sheet, is more important than the particle diameter per se.

The adhesive particles can exhibit the above-described effect when they are contained in an amount of 5 to 100 parts by weight based on 100 parts by weight of the binder, and the content of the adhesive particles may be selected by taking the surface profile of the image receiving sheet into consideration so that the adhesive particles are protruded from the surface of the ink layer to enable the thermal transfer film to be spottedly adhered to the image receiving sheet.

In the present invention, the density of spot adhesion (number of adhesive spots per $mm^2$) between the thermal transfer film and the image receiving sheet is preferably in the range of from 10 to 100,000 spots/$mm^2$. When the density of spot adhesion is less than 10 spots/$mm^2$, the adhesive strength is unsatisfactory. On the other hand, when it exceeds 100,000 spots/$mm^2$, the adhesive strength is excessively high, which gives rise to smudge.

When the content of the adhesive particles is excessively is low, the adhesive property unsatisfactory and the thermal transfer medium is likely to wrinkle. On the other hand, when the content of the adhesive particles is excessively high, there occur problems such as a lowering in the print density and smudge.

The hot-melt ink layer can be formed on the substrate film by a general method which comprises melt-kneading the above-described binder together with other necessary components to provide a melt and applying the melt on the substrate film by hot lacquer coating. In a preferred method, an emulsion ink comprising a mixture of an emulsion prepared by emulsifying or dispersing the binder in an aqueous medium optionally containing an alcohol or the like with an aqueous dispersion of a pigment and adhesive particles is coated and dried. The thickness of the ink layer thus formed is preferably in the range of from about 0.5 to 20 $\mu$m.

In the formation of the hot-melt ink layer, it is possible to form a matte layer having a thickness of about 0.1 to 20 $\mu$m on the surface of the substrate film to impart feeling of matte to the print. In this case, the matte layer is the same as that described above in connection with the first aspect of the present invention. In the present invention, a peeling layer comprising wax may be previously formed on the surface of the substrate film or the surface of the matte layer so that, after the completion of the transfer, the peeling layer can serve as the surface protective layer for a transferred image. The peeling layer may be formed by hot-melt coating, hot lacquer coating or emulsion coating. The thickness of the peeling layer is generally in the range of from about 0.1 to 5 $\mu$m.

The adhesive strength (g) under shear imparted to the ink layer is preferably in the range of from 300 to 2,000 g as measured using a cut sample having a size of 25 mm in width×55 mm in length at a rate of pulling of 1,800 mm/min with a surface abrasion tester (HEIDON-14 manufactured by Shinto Kagaku K.K.). When the adhesive strength is less than the above-described range, since the adhesion between the thermal transfer film and the image receiving sheet is excessively low, the thermal transfer film and the image receiving sheet are likely to peel from each other and the thermal transfer medium is likely to wrinkle. On the other hand, when the adhesive strength exceeds the above-described range, although the adhesion between the thermal transfer film and the image receiving sheet is satisfactory, the ink layer is likely to be transferred to the image receiving sheet also in the non-printing portion, so that the image receiving sheet gives rise to smudge.

The image receiving sheet may be the same as that described above in connection with the first aspect of the present invention.

With respect to the adhering between the thermal transfer film and the image receiving sheet, the image receiving sheet is continuously adhered to the thermal transfer film by taking advantage of the adhesive property imparted to the ink layer of the thermal transfer film, and the laminate is rolled. The laminate may be rolled with the image receiving sheet being outward or the thermal transfer film being outward. Further, the laminate may be cut into sheets.

The thermal transfer medium according to the third aspect of the present invention will now be described.

Figure 4:
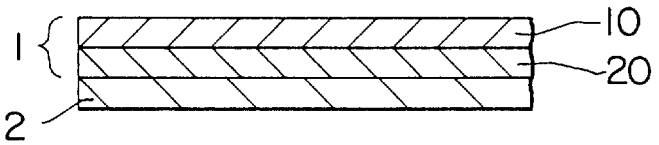
Figure 5:
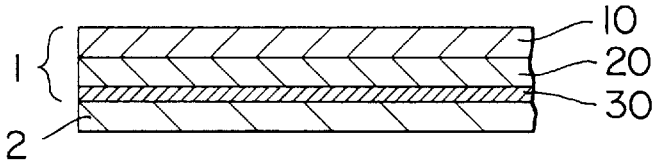
Figure 6:
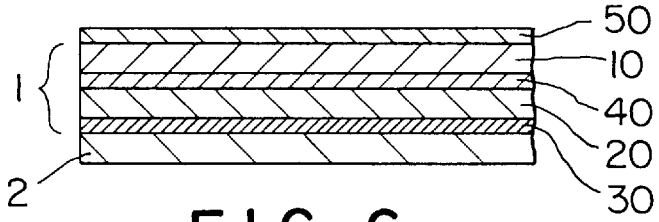

Preferred embodiments of the thermal transfer medium according to the third aspect of the present invention are shown in FIGS. 4, 5, and 6.

As shown in FIG. 4, the thermal transfer medium according to the third aspect of the present invention comprises a thermal transfer film 1 and an image receiving sheet 2 adhered to the thermal transfer film in a peelable manner. The thermal transfer film 1 comprises a film 10 and, provided thereon, an adhesive ink layer 20 containing a pigment, a binder and a thermoplastic elastomer having a rubber elasticity. FIG. 5 is an application example of the thermal transfer medium according to the third aspect of the present invention, wherein a temporary adhesive layer 30 is formed between the ink layer 20 and the image receiving sheet 2. FIG. 6 is another application example wherein a peeling layer and a matte layer 40 are formed between the substrate film 10 and the ink layer 20. Further, a slip layer 50 may be formed on the back surface of the substrate film.

The substrate film used in the thermal transfer medium according to the third aspect of the present invention is the same as that described above in connection with the thermal transfer medium according to the first aspect of the present invention.

In order to prevent the sticking of the substrate film on the thermal head and, at the same time, to improve the slip property, it is possible to provide a slip layer on the back surface of the substrate film. The slip layer is the same as that described above in connection with the first aspect of the present invention.

The hot-melt ink layer provided on the substrate film comprises a pigment, a binder and a thermoplastic elastomer having a rubber elasticity and optionally various additives. In black monocolor printing, it is a matter of course that the pigment is preferably carbon black. In multicolor printing, use may be made of chromatic color pigments such as cyan, magenta and yellow. In general, the amount of use of these pigments is preferably such that these pigments occupy about 5 to 70% by weight of the ink layer.

The binder comprises wax as the main component or a mixture of wax with a drying oil, a resin, a mineral oil, cellulose and a derivative of rubber and the like.

Representative examples of the wax include microcrystalline wax, carnauba wax and paraffin wax. Further examples of the wax usable in the binder include various waxes, such as Fischer-Tropsch wax, various types of polyethylene, Japan wax, beeswax, spermaceti, insect wax, wool wax, shellac wax, candelilla wax, petrolatum, polyester wax, partially modified wax, fatty acid esters and fatty acid amides. Further, the binder may contain at least one thermoplastic resins such ethylene/vinyl acetate copolymer. The present invention is characterized in that the above-described ink layer further comprises a thermoplastic elastomer having a rubber elasticity.

Examples of the thermoplastic elastomer having a rubber elasticity used in the present invention include synthetic rubbers, such as butadiene rubber, styrene-butadiene rubber, nitrile rubber, nitrile-butadiene rubber, high styrene rubber, isoprene rubber and acrylic rubber, and natural rubber. The effect contemplated in the present invention can be attained when the above-described thermoplastic elastomer is contained in an amount of 1 to 50% by weight, and the effect is significant particularly when the content of the thermoplastic elastomer is in the range of from 5 to 40% by weight.

When the content of the thermoplastic elastomer is excessively low, the adhesive property is unsatisfactory and, at the same time, printing failure is liable to occur. On the other hand, when it is excessively high, there is a possibility that problems such as a lowering print density occur.

The thermoplastic elastomer having a rubber elasticity preferably has a tensile strength (JIS K6383) in the range of from 1 to less than 100 kg/cm$^2$. When the tensile strength of the thermoplastic elastomer is less than 1 kg/cm$^2$ and 100 kg/cm$^2$ or more, the print density is lowered.

Further, the thermoplastic elastomer having a rubber elasticity preferably has a Tg value in the range of from −10° to 40° C. When the Tg value is below −10° C., the adhesion between the thermal transfer film and the image receiving sheet becomes so high that it is difficult to peel the printed portion after the printing. On the other hand, when the Tg value exceeds 40° C., the film strength becomes so low that there occur problems such as smudge wherein the ink layer is plundered by the image receiving sheet at its the non-printing portions.

In the present invention, it is important that the adhesive strength under shear in an area of adhesion between the thermal transfer film on the side of the hot-melt ink layer and the image receiving sheet of 2.5×5.5 cm and the 90° C. peeling strength at the printed portion after the printing be in the range of from 300 to 2000 g and in the range of from 0.1 to 50 g/2.5 cm, respectively. When the adhesive strength under shear is less than 300 g or the peeling strength is less than 0.1 g/2.5 cm, although the thermal transfer film can be easily peeled off, since the adhesion between the ink film and the image-receiving paper is poor, the thermal transfer medium is likely to wrinkle during printing. On the other hand, when the adhesive strength under shear is exceeds 2000 g or the peeling strength exceeds 50 g/2.5 cm, it becomes difficult to peel the thermal transfer film after printing or the transferred ink portion becomes liable to be peeled together with the surface of the image receiving sheet to unfavorably cause dropout.

The ink layer containing the thermoplastic elastomer and the image receiving sheet can be laminated on top of the other in a peelable manner. Further, if necessary, a temporary adhesive layer may be separately provided.

The hot-melt ink layer can be formed on the substrate film by a hot-melt coating method which comprises heat-melting the binder composed mainly of wax together with other necessary components to form a melt mixture and coating the melt mixture on the substrate film and other general method which comprises melt-kneading the binder composed mainly of wax together with other necessary components to provide a melt and applying the melt on the substrate film by hot lacquer coating. In a preferred method, an emulsion ink comprising a mixture of an emulsion prepared by emulsifying or dispersing a binder composed mainly of wax in an aqueous medium optionally containing an alcohol or the like with an aqueous dispersion of a pigment and a thermoplastic elastomer is coated and dried. The thickness of the ink layer thus formed is preferably in the range of from about 1 to 20 $\mu$m.

In the formation of the hot-melt ink layer, it is possible to form a matte layer having a thickness of about 0.1 to 20 $\mu$m on the surface of the substrate film to impart feeling of matte to the print. In this case, the matte layer may be formed by hot-melt coating, hot lacquer coating or emulsion coating.

The image receiving sheet preferably has a thickness in the range of from 25 to 500 μm and may be any sheet or film used as an image receiving sheet in the conventional thermal transfer medium, on which an ink layer is transferred to form an image, such as conventional wood free paper, plain paper, coat paper, synthetic paper and plastic films. Although these image receiving sheets may be in a sheet form of A-size, B-size, etc., they are preferably in the form of a continuous sheet having a proper width.

Specific examples of the synthetic paper usable as the image receiving sheet include "Yupo®" manufactured by Oji-Yuka Synthetic Paper Co., Ltd., "Peachcoat®" manufactured by Nisshinbo Industries, Inc., "Yupocoat®" manufactured by Oji-Yuka Synthetic Paper Co., Ltd., "Tyvek®" manufactured by Du Pont (E.I.) de Nemours & Co., "Toyopearl®" and "Crysper®" manufactured by Toyobo Co., Ltd., "Alt®" and "Purely®" manufactured by Awa Paper Mfg, Co., Ltd., "Toughper®" manufactured by Tatsuno Chemicals Co., Ltd. and "Eleven®" manufactured by Tokai Pulp Co., Ltd.

In the present invention, it is also possible to provide a receptive layer having a thickness in the range of from 0.1 to 50 μm for the purpose of improving the receptivity of the image receiving sheet to the ink. The receptive layer has an excellent water resistance and serves to increase the compatibility of the image receiving sheet with the hot-melt ink. The material constituting the receptive layer may be properly selected from, for example, linear polyesters, vinyl chloride/vinyl acetate copolymer, polyurethane, polyethylene wax, maleic-acid-modified rosin derivatives, ester gums by taking the receptivity to the hot-melt ink into consideration. However, the material is not limited to these examples only. It is also possible to use additives for preventing the static electricity, such as surfactants, inorganic fillers (for example, silica, calcium carbonate and titanium oxide) and organic fillers (for example, acrylic ester particulates) for improving the surface gloss or fluorescent brighteners.

The receptive layer may be formed by a proper method selected from conventional coating methods depending upon the kind, condition and coverage of the coating solution and the properties of the image receiving sheet. For example, use may be made of gravure coating, roll coating, knife coating, slide coating and other coating methods. Although a minimum coverage necessary for coating is satisfactory for mere adhering purposes, when impartment of properties such as a fluorescent property is intended, the coating solution is coated in an amount suitable for the purposes. The coverage is preferably in the range of from 0.5 to 50 μm.

Further, in the present invention, if necessary, an antistatic layer may be provided on the laminated surface of the image receiving sheet or its back surface. In this case, cationic surfactants, anionic surfactants, nonionic surfactants, amphoteric surfactants, etc. may be used as the antistatic agent.

Although the temporary adhesive layer, which is optionally provided for the purpose of temporarily adhering the thermal transfer film to the image receiving sheet, may comprise any known adhesive, the adhesive preferably comprises a pressure-sensitive adhesive resin having a glass transition temperature and wax. The adhesive strength (g) of the adhesive layer is preferably in the range of from 300 to 2,000 g as measured using a cut sample having a size of 25 mm in width×55 mm in length at a rate of pulling of 1,800 mm/min with a surface abrasion tester (HEIDON-17 manufactured by Shinto Kagaku K.K.).

When the adhesive strength is less than the above-described range, since the adhesion between the thermal transfer film and the image receiving sheet is excessively low, the thermal transfer film and the image receiving sheet are likely to peel from each other and the thermal transfer medium is likely to wrinkle. On the other hand, when the adhesive strength exceeds the above-described range, although the adhesion between the thermal transfer film and the image receiving sheet is satisfactory, the ink layer is likely to be transferred to the image receiving sheet also in the non-printing portion, so that the image receiving sheet gives rise to smudge.

The pressure-sensitive adhesive resin preferably has a glass transition temperature in the range of from −90° to −50° C., and examples of the pressure-sensitive adhesive resin of this type include rubber pressure-sensitive adhesive resins, acrylic pressure-sensitive adhesive resin and silicone pressure-sensitive adhesive resin. They may be used in any of a solvent solution, aqueous solution, hot-melt and aqueous or oil emulsion form.

Even when the pressure-sensitive adhesive resin is used alone, an excellent pressure-sensitive adhesive property is provided. In this case, however, the peelability of the image receiving sheet is unsatisfactory and uneven, which gives rise to a problem that the application of accidental force to the thermal transfer medium during production, storage, transportation, etc. prior to use. Further, the transferability of the ink layer in the transfer stage is so poor that, for example, the ink layer is transferred also around a region where heat has been applied with a thermal head, which deteriorates the resolution of the transferred image.

When an emulsion of wax of the type as used in the formation of the ink layer is added to the pressure-sensitive adhesive resin emulsion, the pressure-sensitive adhesive property can be regulated in a preferable range, so that the problem of smudge can be solved, which contributes to an improvement in the resolution of the transferred image.

The weight ratio of the pressure-sensitive adhesive resin to the wax is preferably in the range of from 1:0.5 to 1:4. When the weight ratio is outside this range, the above-described various problems unfavorably occur.

The temporary adhesive layer comprising the above-described components may be provided on the surface of the image receiving sheet. In this case, however, the adhesive property is left in the print, so that it is preferred to provide the temporary adhesive layer on the surface of the ink layer of the thermal transfer film. The provision of the temporary adhesive layer on the surface of the ink layer of the thermal transfer film is advantageous in that, since the pressure-sensitive adhesive resin is used in the form of an aqueous emulsion, there is no adverse effect on the ink layer. There is no particular limitation on the emulsion coating method and drying method. The thickness of the temporary adhesive layer is preferably in the range of from 0.1 to 10 μm (0.05 to 5 g/m$^2$ in terms of the coverage on a dry basis).

With respect to the adhering between the thermal transfer film and the image receiving sheet, the image receiving sheet is continuously adhered to the thermal transfer film by taking advantage of the adhesive property imparted to the ink layer of the thermal transfer film, and the laminate is rolled. The laminate may be rolled with the image receiving sheet being outward or the thermal transfer film being outward. Further, the laminate may be cut into sheets.

EXAMPLES

The present invention will now be described in more detail with reference to the following Examples. In the Examples, "parts" or "%" is by weight unless otherwise specified.

Example A1

A matte layer having the following composition was formed on one surface of a substrate film comprising a 4.5 μm-thick polyethylene terephthalate film and a slip layer provided on the back surface thereof, and the following ink composition 1 was coated on the matte layer by gravure coating at a coverage of 3 g/m$^2$ on a dry basis to form a coating which was then dried at a temperature of 80° to 90° C. to form an ink layer. A temporary adhesive layer having the following composition was formed on the ink layer by gravure coating at a coverage of 0.3 g/m$^2$ on a dry basis to provide the thermal transfer film of the present invention.

| Coating solution for matte layer | |
|---|---|
| Carbon black | 50 parts |
| Polyester resin | 50 parts |
| Isocyanate | 3 parts |
| MEK/toluene (1/1) | 60 parts |
| **Ink composition 1** | |
| Carbon black | 13 parts |
| Carnauba wax | 9 parts |
| Paraffin wax | 60 parts |
| Ethylene/vinyl acetate copolymer | 24 parts |
| Microcrystalline wax | 3 parts |
| **Composition 1 for temporary adhesive layer** | |
| Carnauba wax emulsion | 70 parts |
| Microcrystalline wax emulsion | 10 parts |
| EVA particles (average particle diameter: 10 μm) | 20 parts |

After the formation of the thermal transfer film, the thermal transfer film and coated paper (an image receiving sheet) were laminated on top of the other at a nip temperature of 50° C. and a nip pressure of 5 kg/cm$^2$ to provide the thermal transfer medium of the present invention.

Example A2

A thermal transfer medium was provided in the same manner as that of Example A1, except that a composition 2 for a temporary adhesive layer was used instead of the composition 1 for a temporary adhesive layer.

| Composition 2 for temporary adhesive layer | |
|---|---|
| Carnauba wax emulsion | 40 parts |
| Polyester wax emulsion | 40 parts |
| EVA particles (average particle diameter: 10 μm) | 20 parts |

Comparative Example A1

A thermal transfer medium was provided in the same manner as that of Example A1, except that a composition 3 for a temporary adhesive layer was used instead of the composition 1 for a temporary adhesive layer.

| Composition 3 for temporary adhesive layer | |
|---|---|
| Acrylic resin emulsion | 10 parts |
| Carnauba wax emulsion | 20 parts |
| Isopropanol | 60 parts |
| Water | 30 parts |

Comparative Example A2

A thermal transfer medium was provided in the same manner as that of Example A1, except that a composition 4 for a temporary adhesive layer was used instead of the composition 1 for a temporary adhesive layer.

| Composition 4 for temporary adhesive layer | |
|---|---|
| Silicone-modified acrylic resin emulsion | 10 parts |
| Carnauba wax emulsion | 20 parts |
| Isopropanol | 60 parts |
| Water | 30 parts |

These thermal transfer media were set in a facsimile printer, an energy of 0.3 mJ/dot was applied to the thermal head under an environment of 25° C. and a humidity of 50% to effect printing, and the material on which an image has been transferred was peeled to form a desired image on this material. At that time, the occurrence of wrinkle, adhesive strength and printing sensitivity were evaluated. The thermal transfer media were allowed to stand in a rolled state under an environment of 50° C. for 2 weeks, and the peeling was effected to evaluate the state of smudge in the material on which an image is to be transferred.

Example A3

A thermal transfer medium was provided in the same manner as that of Example A1, except that the following ink composition was used instead of the composition 1.

| Ink composition | |
|---|---|
| Copper phthalocyanine green | 13 parts |
| Carnauba wax | 9 parts |
| Paraffin wax | 60 parts |
| Ethylene/vinyl acetate copolymer | 24 parts |
| Microcrystalline wax | 3 parts |

Example A4

A thermal transfer medium was provided in the same manner as that of Example A1, except that the following ink composition was used instead of the composition 1.

| Ink composition | |
|---|---|
| Pigment red | 13 parts |
| Carnauba wax | 9 parts |
| Paraffin wax | 60 parts |
| Ethylene/vinyl acetate copolymer | 24 parts |
| Microcrystalline wax | 3 parts |

Example A5

A thermal transfer medium was provided in the same manner as that of Example A1, except that the following ink composition was used instead of the composition 1.

| Ink composition | |
|---|---|
| Phthalocyanine blue | 13 parts |
| Carnauba wax | 9 parts |
| Paraffin wax | 60 parts |
| Ethylene/vinyl acetate copolymer | 24 parts |
| Microcrysta11ine wax | 3 parts |

TABLE A1

| | Wrinkle | Adhesive Strength | Printing Sensitivity | Smudge |
|---|---|---|---|---|
| Ex. A1 | ○ | 800 g | ◎ | ◎ |
| Ex. A2 | ◎ | 1000 g | ◎ | ◎ |
| Ex. A3 | ○ | 800 g | ◎ | ◎ |
| Ex. A4 | ○ | 800 g | ◎ | ◎ |
| Ex. A5 | ○ | 800 g | ◎ | ◎ |
| Comp. Ex. A1 | ○ | 1000 g | Δ | X |
| Comp. Ex. A2 | ○ | 800 g | Δ | X |

Evaluation criteria were as follows.

Wrinkle

◎: No wrinkle occurred.
○: Substantially no wrinkle occurred.

Printing sensitivity

◎: Good
Δ: Slightly poor

Smudge

◎: Good (no smudge occurred)
X: Occurred (dusty)

Thus, according to the present invention, the formation of a temporary adhesive layer containing adhesive particles between the ink layer and the image receiving sheet enables the thermal transfer film and the image receiving sheet to be spottedly adhered to each other with the adhesive strength therebetween being successfully regulated as desired. Further, when the minimum film formation temperature of the adhesive particles is 50° C. or above, since the particle shape of the adhesive particles can remain unchanged during storage even under an environment of 50° C., a thermal transfer medium having an excellent storage stability can be provided.

Example B1

A coating solution for a matte layer having the following composition was coated on one surface of a substrate film comprising a 4.5 μm-thick polyethylene terephthalate film and a slip layer provided on the back surface thereof at a coverage of 0.5 g/m$^2$ and dried at a temperature of 80° to 90° C. to form a matte layer, and the following ink composition 1 was coated on the matte layer by gravure coating at a coverage of 4 g/m$^2$ on a dry basis to form a coating which was then dried at a temperature of 80° to 90° C. to form an ink layer.

| Coating solution for matte layer | |
|---|---|
| Carbon black | 24 parts |
| Polyester resin | 16 parts |
| Dispersant | 1.5 parts |
| Curing agent | 3 parts |
| MEK/toluene (1/1) | 60 parts |

| Ink composition 1 | |
|---|---|
| Carbon black | 10 parts |
| Carnauba wax emulsion | 30 parts |
| Paraffin wax emulsion | 20 parts |
| EVA particles (minimum film forming temp.: 70° C., average particle diameter: 10 μm) | 10 parts |
| Water | 30 parts |

After the formation of the ink layer, the resultant thermal transfer film and coated paper (an image receiving sheet) were laminated on top of the other at a nip temperature of 50° C. and a nip pressure of 5 kg/cm$^2$ to provide the thermal transfer medium of the present invention.

Example B2

A thermal transfer medium was provided in the same manner as that of Example B1, except that the following ink composition 2 was used instead of the ink composition 1.

| Ink composition 2 | |
|---|---|
| Copper phthalocyanine green | 10 parts |
| Carnauba wax emulsion | 30 parts |
| Polyester wax emulsion | 10 parts |
| Ionomer particles (minimum film formation temp.: 80° C., average particle diameter: 0.2 μm) | 20 parts |
| Water | 20 parts |

Comparative Example B1

A thermal transfer medium was provided in the same manner as that of Example B1, except that the following ink composition 3 was used instead of the ink composition 1.

| Ink composition 3 | |
|---|---|
| Carbon black | 10 parts |
| Carnauba wax | 40 parts |
| Paraffin wax | 10 parts |
| Microcrystalline wax | 10 parts |
| Water | 30 parts |

Comparative Example B2

A thermal transfer medium was provided in the same manner as that of Example B1, except that the following ink composition 4 was used instead of the ink composition 1 and a temporary adhesive having the following composition was coated on the ink layer by gravure coating at a coverage of 0.5 g/m$^2$ on a dry basis to form a temporary adhesive layer.

| Ink composition 4 | |
|---|---|
| Carbon black | 10 parts |
| Carnauba wax | 40 parts |
| Polyethylene wax | 10 parts |
| Paraffin wax | 5 parts |
| Water | 40 parts |

-continued

| Temporary adhesive composition | |
|---|---|
| Acrylic resin emulsion | 10 parts |
| Carnauba wax emulsion | 20 parts |
| Isopropanol | 60 parts |
| Water | 30 parts |

Example B3

A thermal transfer medium was provided in the same manner as that of Example B1, except that the following ink composition was used instead of the ink composition 1.

| Ink composition | |
|---|---|
| Phthalocyanine | 10 parts |
| Carnauba wax | 50 parts |
| Microcrystalline wax | 30 parts |
| EVA particles (minimum film formation temp.: 90° C., average partcile diameter: 20 μm) | 10 parts |

Example B4

A thermal transfer medium was provided in the same manner as that of Example B1, except that the following ink composition was used instead of the ink composition 1.

| Ink composition | |
|---|---|
| Carbon black | 15 parts |
| Paraffin wax | 50 parts |
| Microcrystalline wax | 30 parts |
| EVA particles (minimum film formation temp.: 70° C., average particle diameter: 40 μm) | 10 parts |

Example B5

A thermal transfer medium was provided in the same manner as that of Example B1, except that the following ink composition was used instead of the ink composition 1.

| Ink composition | |
|---|---|
| Carbon black | 10 parts |
| Carnauba wax emulsion | 30 parts |
| Paraffin wax emulsion | 10 parts |
| Ionomer particles (minimum film formation temp.: 90° C., average particle diameter: 0.1 μm) | 40 parts |
| Water | 10 parts |

These thermal transfer media were set in a facsimile printer, an energy of 0.3 mJ/dot was applied to the thermal head under an environment of 25° C. and a humidity of 50% to effect printing, and the material on which an image has been transferred was peeled to form a desired image on this material. At that time, spot adhesion density, storage stability, cost and printing sensitivity were evaluated. The thermal transfer media were allowed to stand in a rolled state under an environment of 50° C. for 2 weeks, and the peeling was effected to evaluate the state of smudge in the material on which an image is to be transferred.

TABLE B1

| | Printing Sensitivity | Spot Adhesion Density | Storage Stability | Cost |
|---|---|---|---|---|
| Ex. B1 | ◎ | 1000 | ◎ | ○ |
| Ex. B2 | ◎ | 30000 | ◎ | ○ |
| Ex. B3 | ◎ | 200 | ◎ | ○ |
| Ex. B4 | ○ | 5 | ◎ | ○ |
| Ex. B5 | ○ | 150000 | ○ | ○ |
| Comp. Ex. B1 | Δ | — | X | X |
| Comp. Ex. B2 | X | — | X | X |

Thus, according to the present invention, the addition of adhesive particles to the ink layer enables an adhesive property to be imparted to the ink layer, so that the need of separately providing a temporary adhesive layer is eliminated, which contributes to an improvement in the printing sensitivity. Further, since the thermal transfer film and the image receiving sheet can be spottedly adhered to each other, the adhesive strength can be successfully regulated as desired and, further, the particle shape of the adhesive particles remains unchanged during storage, so that the storage stability can be improved.

Example C1

A coating solution for a matte layer having the following composition was coated on one surface of a substrate film comprising a 4.5 μm-thick polyethylene terephthalate film and a slip layer provided on the back surface thereof at a coverage of 0.5 g/m$^2$ and dried at a temperature of 80° to 90° C. to form a matte layer, and the following ink composition 1 was coated on the matte layer by gravure coating at a coverage of 4 g/m$^2$ on a dry basis to form a coating which was then dried at a temperature of 80° to 90° C. to form an ink layer.

| Coating solution for matte layer | |
|---|---|
| Carbon black | 24 parts |
| Polyester wax | 16 parts |
| Dispersant | 1.5 parts |
| Curing agent | 3 parts |
| MEK/toluene (1/1) | 60 parts |
| **Ink composition 1** | |
| Carbon black | 10 parts |
| Carnauba wax | 40 parts |
| Acrylonitrile butadiene rubber latex (Tg: 4° C.) | 10 parts |
| Ethylene/vinyl acetate copolymer | 10 parts |
| Water | 30 parts |

After the formation of the ink layer, the resultant thermal transfer film and a polyester nonwoven fabric were laminated on top of the other at a nip temperature of 50° C. and a nip pressure of 5 kg/cm$^2$ to provide the thermal transfer medium of the present invention.

Example C2

A thermal transfer medium was provided in the same manner as that of Example C1, except that the following ink composition 2 was used instead of the ink composition 1.

| Ink composition 2 | |
|---|---|
| Carbon black | 10 parts |
| Carnauba wax | 40 parts |
| Styrene/butadiene rubber latex (Tg: 20° C.) | 10 parts |
| Ethylene/vinyl acetate copolymer | 10 parts |
| Water | 30 parts |

Example C3

A thermal transfer medium was provided in the same manner as that of Example C1, except that the following ink composition 3 was used instead of the ink composition 1 and a temporary adhesive having the following composition was coated on the ink layer at a coverage of 0.5 g/m$^2$ on a dry basis to form a temporary adhesive layer.

| Ink composition 3 | |
|---|---|
| Carbon black | 10 parts |
| Carnauba wax | 40 parts |
| Acrylonitrile-butadiene rubber latex (Tg: −30° C.) | 10 parts |
| Ethylene/vinyl acetate copolymer | 5 parts |
| Water | 40 parts |
| Temporary adhesive composition | |
| Acrylic resin emulsion | 10 parts |
| Carnauba wax emulsion | 20 parts |
| Isopropanol | 60 parts |
| Water | 30 parts |

Example C4

A thermal transfer medium was provided in the same manner as that of Example C3, except that the following ink composition 4 was used instead of the ink composition 3 and the resultant thermal transfer film was laminated on Peach-coat® (manufactured by Nisshinbo Industries. Inc.) as the image receiving sheet.

| Ink composition 4 | |
|---|---|
| Carbon black | 10 parts |
| Carnauba wax | 40 parts |
| Styrene/butadiene rubber latex (Tg: 20° C.) | 10 parts |
| Ethylene/vinyl acetate copolymer | 5 parts |
| Water | 40 parts |

Example C5

A thermal transfer medium was provided in the same manner as that of Example C3, except that the following ink composition 5 was used instead of the ink composition 3 and the resultant thermal transfer film was laminated on Yupo®, manufactured by Oji-Yuka Synthetic Paper Co., Ltd., as the image receiving sheet.

| Ink composition 5 | |
|---|---|
| Carbon black | 15 parts |
| Carnauba wax | 40 parts |

-continued

| Ink composition 5 | |
|---|---|
| Styrene/butadiene rubber latex (Tg: 50° C.) | 20 parts |
| Water | 15 parts |

Example C6

A thermal transfer medium was provided in the same manner as that of Example C3, except that the following ink composition 6 was used instead of the ink composition 3.

| Ink composition 6 | |
|---|---|
| Carbon black | 15 parts |
| Carnauba wax | 40 parts |
| Styrene/butadiene rubber latex (Tg: −12° C.) | 20 parts |
| Ethylene/vinyl acetate copolymer | 10 parts |
| Water | 15 parts |

Comparative Example C1

A thermal transfer medium was provided in the same manner as that of Example C3, except that the following ink composition 7 was used instead of the ink composition 3.

| Ink Composition 7 | |
|---|---|
| Carbon black | 15 parts |
| Carnauba wax | 40 parts |
| Ethylene/vinyl acetate copolymer | 10 parts |
| Water | 35 parts |

Comparative Example C2

A thermal transfer medium was provided in the same manner as that of Example C1, except that the following ink composition 7 was used instead of the ink composition 1. However, the thermal transfer medium could not be provided as an integral thermal transfer medium.

These thermal transfer media were set in a facsimile printer, an energy of 0.3 mJ/dot was applied to the thermal head under an environment of 25° C. and a humidity of 50% to effect printing, and the material on which an image has been transferred was peeled to form a desired image on this material. At that time, the evaluation as given in Table C1 was effected.

TABLE C1

| | Wrinkle | Adhesive Strength | Peeling Strength | Quality of Print | Smudge |
|---|---|---|---|---|---|
| Ex. C1 | ○ | 1000 g | 15 g | ○ | ◎ |
| Ex. C2 | ○ | 800 g | 10 g | ○ | ◎ |
| Ex. C3 | ○ | 1100 g | 30 g | ○ | ○ |
| Ex. C4 | ○ | 1000 g | 10 g | ○ | ◎ |
| Ex. C5 | ○ | 900 g | 5 g | ○ | ○ |
| Ex. C6 | ○ | 1000 g | 20 g | ○ | ○ |
| Comp. Ex. C1 | ○ | 1000 g | 2 g | X | ○ |
| Comp. Ex. C2 | X | 0 g | — | Impossible to print | — |

Evaluation of Wrinkle

Wrinkle generated on the thermal transfer medium during printing was observed with the naked eye.

Evaluation of Adhesive Strength

A sample having a size of 25 mm in width and 55 mm in length was cut and subjected to the measurement of adhesive strength at a rate of pulling of 1,800 mm/min with a surface abrasion tester (HEIDON-17 manufactured by Shinto Kagaku K.K.).

Evaluation of Peeling Strength

A test piece having a width of 25 mm was cut and subjected to the measurement of 90° peeling strength of the printed portion at a rate of pulling of 1,800 mm/min with a surface abrasion tester (HEIDON-17 manufactured by Shinto Kagaku K.K.) according to JIS K6854.

A 90° peeling strength of 50 g/25 mm or less in the peeling after the printing is acceptable. On the other hand, a 90° peeling strength exceeding 50 g/25 mm is causative of printing failure such as streaking.

Evaluation of Quality of Print

After printing was effected with a facsimile printer under an environment of a temperature of 25° C. and a humidity of 50%, the quality of the print was evaluated.

Evaluation of Smudge

The ink sheet and the image receiving paper were, laminated on top of the other, and one month after the lamination, the ink sheet was peeled off to evaluate the smudge.

Thus, according to the present invention, the addition of the thermoplastic elastomer having a rubber elasticity to the ink layer enables an adhesive property to be imparted to the ink layer and, at the same time, the cohesive force of the ink layer to be enhanced, so that it is possible to provide a thermal transfer medium free from occurrence of reverse transfer and tailing.

We claim:

1. A thermal transfer medium comprising:

a thermal transfer film having a substrate film and a hot-melt ink layer formed on a surface of said substrate film;

an image-receiving sheet adhered to said thermal transfer film on the side of said hot-melt ink layer but capable of being peeled from said thermal transfer film; and an adhesive layer, formed on said hot-melt ink layer for adhering said image-receiving sheet to said thermal transfer film but readily permitting said image-receiving sheet to be separated from said thermal transfer film, said adhesive layer being formed from a binder and adhesive particles that are used to adhere spottedly said image-receiving sheet to said thermal transfer film, said adhesive particles having (a) an initial diameter larger than the thickness of said adhesive layer, said initial diameter being 1 to 100 $\mu$m, and (b) a minimum film formation temperature in the range of 50° to 150° C., wherein the number of points of contact of the adhesive particles between said thermal transfer film and said image-receiving sheet is in the range of 10 to 100,000 points/mm$^2$.

2. The thermal transfer medium of claim 1, wherein said binder is at least one of wax and a resin having a Tg value in the range of 50° to 150° C.

3. The thermal transfer medium of claim 1 wherein said adhesive layer has an adhesive strength of from about 300 to about 2,000 g as measured using a cut sample 25 mm wide by 55 mm long at a pulling rate of 1800 mm/min with a surface abrasion tester.

* * * * *